United States Patent [19]

Rose

[11] 4,152,791

[45] May 8, 1979

[54] FLUID CONTROL ARRANGEMENTS, APPLICABLE TO SPA FACILITIES

[76] Inventor: Alan C. Rose, 5030 Calvin Ave., Tarzana, Calif. 91356

[21] Appl. No.: 620,148

[22] Filed: Oct. 6, 1975

[51] Int. Cl.[2] ..... E04H 3/16

[52] U.S. Cl. ..... 4/172

[58] Field of Search ..... 4/152, 153, 160, 162, 4/171, 172, 172.12, 172.15, 172.17, 178, 180, 181

[56] References Cited

U.S. PATENT DOCUMENTS

| | | | |
|---|---|---|---|
| 3,078,472 | 2/1963 | Salisbury | 4/171 |
| 3,373,740 | 3/1968 | Riepl | 4/180 X |
| 3,483,863 | 12/1969 | DeVane | 4/179 |
| 3,488,782 | 1/1970 | Billig et al. | 4/172 |
| 3,621,496 | 11/1971 | McWilliams | 4/172 |
| 3,636,944 | 1/1972 | Bryant | 4/180 |
| 3,747,131 | 7/1973 | Koliomichalis | 4/172.12 |
| 3,781,925 | 1/1974 | Curtis et al. | 4/172.15 |
| 3,801,994 | 4/1974 | Brown | 4/172.12 |

*Primary Examiner*—Charles E. Phillips

[57] ABSTRACT

A spa facility includes a pliable container, and flexible hoses for connecting to the pump and heater of a conventional pool, as well as to a source of compressed air. A flotation member is secured to the rim of the container. A plastic dome includes double tubes along its rim, one filled with air and the other with water, and is inflated by the pressurized air bubbling up out of the spa container. The pliable container is supported by pool water and/or a supplemental stiff supporting container.

9 Claims, 4 Drawing Figures

FLUID CONTROL ARRANGEMENTS, APPLICABLE TO SPA FACILITIES

BACKGROUND OF THE INVENTION

The present invention relates to fluid containing arrangements which are particularly applicable to inexpensive spatype facilities which may be used with an existing pool.

In recent years it has become more common to provide spa-type arrangements constituting a separate small "spa" or health pool when a pool installation is built. By the addition of an air compressor and suitable valving the water may be recirculated from the spa, and the large capacity pool heater rapidly heats the small "spa" pool adjacent the main pool up to a thearapeutic temperature such as 95° F. to 110° F. or slightly higher. Air under pressure is bubbled through the spa to supplement water jets to complete the massage action of the "spa".

For persons having a regular pool built several years ago before spas became available, however, it is expensive to install a spa, costing at least one thousand and sometimes two or three thousand dollars to make this change.

SUMMARY OF THE INVENTION

In accordance with an important aspect of the present invention, an inexpensive spa or similar arrangement can readily be added to an existing pool at a cost which is much lower than the thousand dollar figure noted above. More specifically, an inexpensive container of flexible or pliable material may be suitably supported to retain its shape when filled, and flexible hoses may be connected to existing pool inlets and outlets and to an air compressor to produce a "spa" facility.

One aspect of the invention involves the use of a floating ring (an inflatable ring or plastic foam ring) which supports the outer rim of the flexible container. The container is filled with hot water by a local loop with the pool heater made with flexible conduit or hose preferably connected to the pool inlet and outlet fittings.

An inflatable plastic dome may be provided which can be inflated, for example, by bubbling air from the surface of water below the dome. The plastic dome may be provided with two rings, one filled with water and the other with air to properly position it on the water surface against wind or the like.

Another feature of the invention involves the use of a small low cost flexible walled container, suitably supported to avoid collapse when it is filled, and flexible hoses for connection to the pool plumbing, to obtain the use of the pool pump and heater to elevate the temperature of the water in the container rapidly.

A broad aspect of the invention involves the use of a flexible or pliable container having a rim enclosing a surface area of an extended volume of water, and arrangements for supplying fluid, into the enclosed water to fill the container.

A particular advantage of the invention is its application to the increased use of swimming pools in colder weather despite increased energy costs. Whereas it might take $100 and two days to heat a swimming pool from 55° F. to a "swimmable" temperature such as 80° F. in cold weater, the principles of the present invention would permit the selection and temperature isolation of a suitable small volume of water in a swimming pool and its rapid heating to the desired temperature at low cost.

Other features and advantages of the present invention will become apparent from a consideration of the following detailed description and from the drawings in which.

Figure 1:
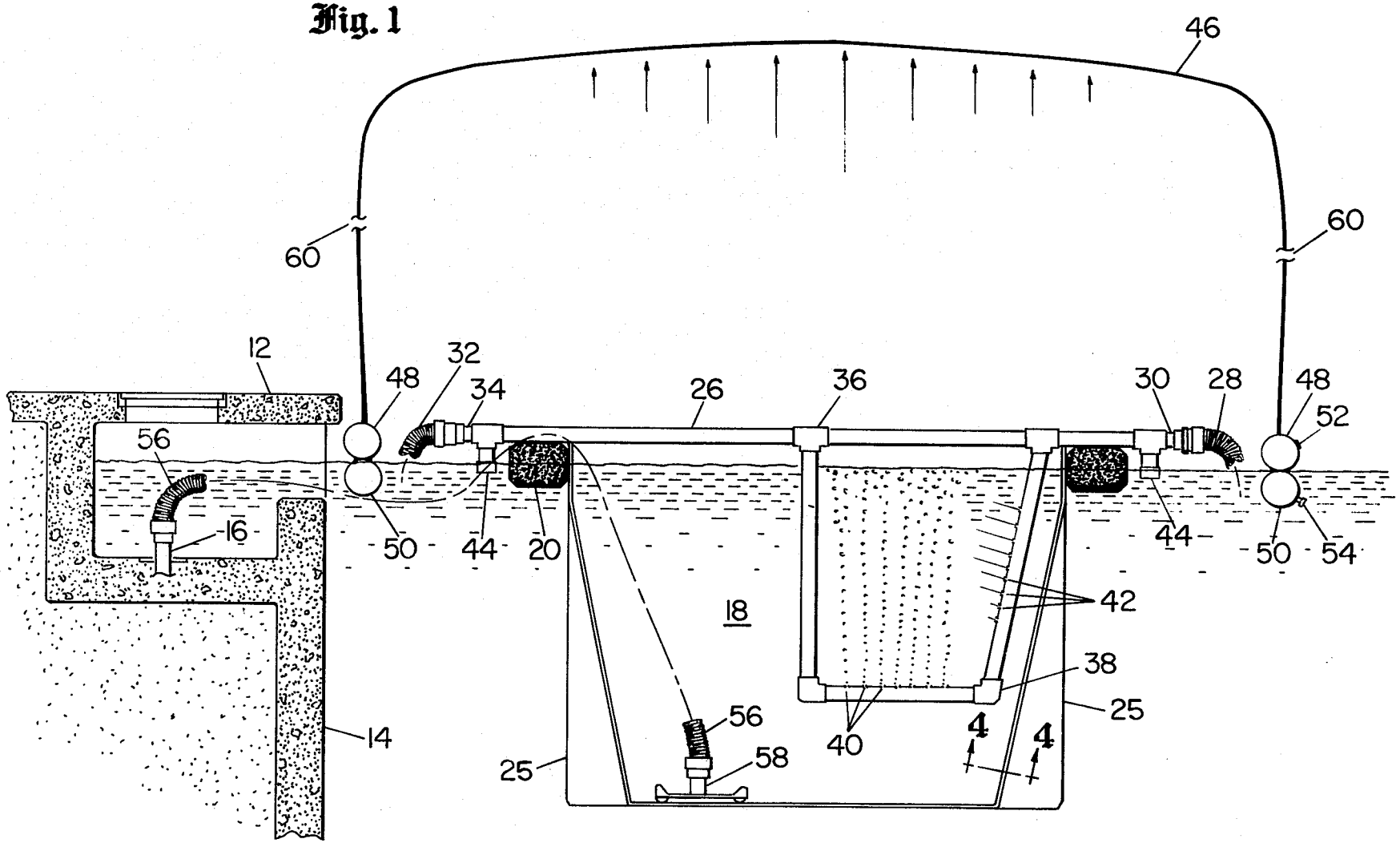
FIG. 1 is a side view of the preferred embodiment of the invention.

Referring more particularly to the drawings, FIG. 1 shows a portion of a conventional swimming pool having a deck 12, a concrete pool wall and a skimmer return 16 to the pump, filter and heater of the conventional pool system.

One illustrative embodiment of the present invention involves the use of a container 18 for the inexpensive temperature isolation of a portion of the volume of the swimming pool. To isolate the container 18 from the flow of cold water from the main part of the swimming pool, a floating perimeter ring 20 is employed. This floating ring 20 may be made of foam and secured to the rim of the container 18; or it may be an inflatable tube formed at the periphery of a flexible plastic bubble 18 of any desired size.

Now, considering the detailed construction of the container 18, it inclues a flexible inner container 22 (see the detail of FIG. 4) and a firm or semi-rigid supporting container 24, having ribs 25 to improve its rigidity. The two containers overlap and are supported by the perimeter float 20. If desired, either or both of the containers 22, 24 may be provided with an integral tube for flotation at their rims, which could be inflatable or otherwise bouyant.

Hot water and air under pressure may be supplied to the container 18 in any desired manner. In FIG. 1, plastic piping 26 supported on the float 20 provides a combined seat and a suitable arrangement for introducing hot water and air under pressure into the water within container 18. More specifically, hot water from the pool heater may be supplied through flexible hose 28 to one end 30 of the plastic piping 26; while another flexible conduit or hose 32 supplies pressurized air to another end of the piping 26. The piping is blocked off at 36 and 38, for example, and the pressurized air is bubbled through openings 40 in that portion of the piping 26 making up the seat of the "chair"; while hot water is directed through openings 42, in the "back" of the "chair".

Depending pipe stubs 44 hold the plastic piping in place on the float 20.

A plastic dome 46 may also be provided, and is particularly useful with severe cold or when a cold breeze is blowing. The dome is made of heavy inflatable flexible plastic, and may be provided with two integral inflatable rings 48 and 50 at its rim. These rings 48 and 50 may be provided with suitable inlets connections 52 and 54, respectively, of known types, for filling the rings with fluid such as air or water, and for sealing the rings. In FIG. 1 the upper ring 48 is filled with air, while the lower tube 50 is filled with water, to position the rim of the dome 46 on the surface of the water, and to make secure against being easily blown away. Without the air to provide buoyancy the plastic dome could easily drift below the surface of the water; and without the water to add inertia it could easily be blown away.

The closed local loop between the water in container 18 and the pool pump and heater is completed by the return flexible conduit or hose 56 running to the skimmer return 16 from the pool. Within container 18, the return line 56 may be held below the surface of the water in any suitable manner. With a fairly rigid container 18, a weighted inlet 58 may be employed, and one suitable inlet is the pool vacuum pick-up element shown in FIG. 1 at 58. When a more flexible container 18 is used, the hot water return may be secured to a float or to the floating seat, so that the inlet is below the surface of the water.

Breaks 60 are shown in the plastic dome to indicate that it can be higher than shown. For example, it might be useful to have the vertical extent of the dome be about 6 feet so that, if the container it were used on the pool deck, the plastic dome would still extend 3 feet or so over the top of it. Also by utilizing plastic dome 46 as a water container in the pool, a small hot swimming area can be segregated in a cold pool, and greater flexibility is provided.

Figure 2:
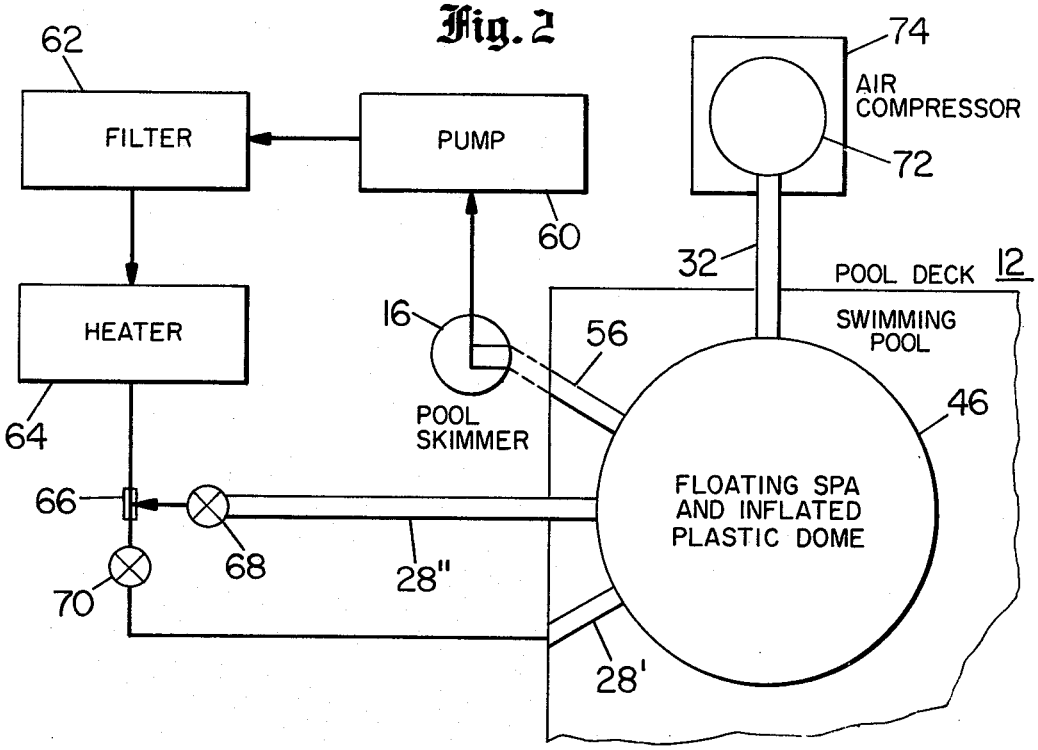
FIG. 2 is a diagram indicating the connections of the flexible conduits with the remainder of the pool plumbing.

FIG. 2 is a schematic plan view showing the plastic dome 46, and the various flexible conduits connected to the floating spa container 18 below the dome 46. In FIG. 2 the normal pool plumbing equipment, including the pump 60, the filter 62 and the pool heater 64, are shown. The hot water return flexible conduit 56 is connected to the pool skimmer return 16. Hot water direct from heater 64 is returned to the container 18 over one or more of the flexible conduits 28' or 28''. The flexible conduit 28' is connected to the normal return to the pool, after the interchange of fittings at the pool wall. Pools often have one or more basic threaded fittings attached to the pipe running to the pool from the heater with water directing outlets or nozzles having matching threads screwed into the basic fitting. By unscrewing the nozzle and replacing it with a fitting suitable for use with the flexible conduit, it is unnecessary to cut into the pool plumbing.

In some instances, however, it may be useful to provide alternative or additional hot water flow, and this may be accomplished by the addition of "T" plumbing connection 66 and valve 68, in addition to valve 70 if not already present in the pool plumbing. By closing valve 70 and opening valve 68, the hot water may be directed to the container 18 solely through flexible conduit 28''. Alternatively, both valves 68 and 70 may be opened and both conduits 28' and 28'' employed to direct hot water to the container 18. The commercially available electrically powered air compressor 72 mounted on base 74 directs air under pressure to container 18 through flexible conduit 32.

Figure 3:
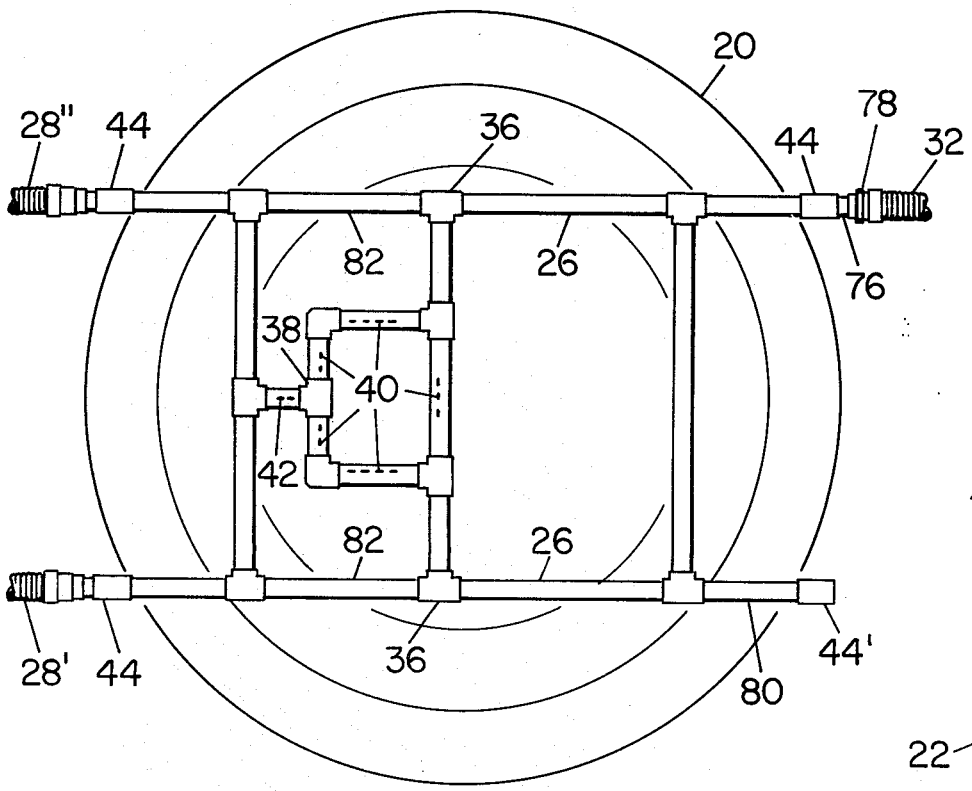
FIG. 3 is a plan view of illustrative arrangements for admitting hot water and air under pressure into the "spa"

FIG. 3 shows one possible implementation of arrangements for introducing air and hot water into the container 18. While the embodiment of FIG. 3 is shown as constructed of conventional plastic pipe, with mass production simpler and less expensive arrangements for accomplishing the functions may of course be implemented.

In FIG. 3, in which the same reference numerals as shown in FIG. 1 are employed, the plastic piping 26 rests on the floating ring 20. Incidentally, the container 18 may be secured to the floating ring 20 as shown in FIG. 1, or alternatively, the container 18 may be somewhat larger and fully flexible with an air inflated integral upper ring at its rim, so that the ring 20 floats freely within container 18.

Now, continuing with the showing of FIG. 3, the "seat" formed by plastic piping 26 is held onto float 20 by "T" pipe fittings 44 having a depending stub as shown in FIG. 1.

The air-inlet hose 32 is connected to one end 76 of the piping 26 which extends out from the float 20. With the highly pressurized air supplied over conduit 32, an additional clamp 78 may be used to hold the air hose in place. Air passes through the plastic tubing and bubbles out through holes 40 in the "seat" below the surface of the water. Escape of air from end 80 of the piping is conveniently prevented by forming the depending stub 44' as a capped "L", instead of a "T" fitting.

Hot water is supplied to the piping 26 over conduits 28' and 28''. This hot water is directed through openings 42 to impinge on the back of the user of the apparatus. Suitable blockages are introduced into fittings 36 and 38 or at other points in the plastic plumbing to isolate the pressurized air and hot water flow as described above. This can be accomplished, for example by introducing a plastic disc into the "T" fittings 36 as the plastic pipe sections 82 are glued into place.

Figure 4:
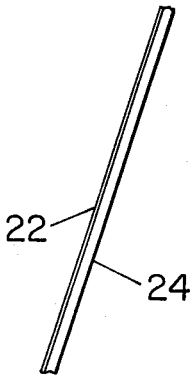
FIG. 4 is a detailed cross-sectional view of the side of the "spa" of FIG. 1.

FIG. 4 is a schematic showing of the wall of container 18 at the place indicated by the arrows 4—4 in FIG. 1. It shows the pliable inner wall 22 and the thicker outer wall 24 which provides mechanical support and heat insulation. The inner wall 22 may be very flexible and thin, or may be merely pliable, but capable of holding its own shape. Present day plastic manufacturing and forming techniques are quite advanced, and a full range of materials of varying thickness, rigidity and strength are available.

With regard to the flexible conduit, which is disclosed throughout the present specification, it may obviously be of different forms; however, one acceptable form is a high grade form of vacuum hose used for vacuuming pools. The normal home pool has a skimmer pool return fitting with an outer diameter of 1½", with larger pools having larger diameter fittings. The conduit is ribbed to provide flexibility, and the heavier end fittings on the flexible conduit make a tight slide fit onto the 1½" skimmer pool return fitting. Using these hoses or flexible conduits, the arrangements as described herein can be put into operation in a matter of minutes.

In closing, it is noted that the present invention has several aspects, and it is intended that the invention encompasses all of the aspects and features as set forth in the appended claims.

I claim:

1. In a spa-type arrangement for use with an existing pool having a pump, filter, and heater:

a small inexpensive pliable container large enough to hold at least one person;

means for supporting said pliable container so that it will retain its normal fully extended shape when filled with water;

flexible hose means for supplying said container with hot water from the pool heater;

means connected to the end of said flexible hose away from said heater for directing a stream of hot water direct from said heater into the water within said container and below the surface of the water within said container;

additional flexible hose means for recirculating water from said pliable container directly to the swimming pool recirculation inlet; whereby said pool heater is capable of rapidly heating the water in said container to spa level temperatures; and said arrangements further including means for providing heat insulation for the water within said container.

2. A spa-type arrangement as defined in claim 1 for use in adverse weather conditions, wherein means are provided for supplying air under pressure into said container to provide spa-type bubble action and wherein an inflatable plastic dome is positioned over said container to be inflated by the air under pressure bubbling out of the water of said container, whereby the air serves to provide massage action, dome supporting pressure, and ventilation while a user is protected from adverse weather conditions.

3. An arrangement as defined in claim 2 wherein flotation means are provided along the rims of said container and said dome to cause the rims to remain in engagement with the water.

4. An inexpensive spa-type arrangement as defined in claim 2 for use with an unheated pool exposed to adverse weather conditions further including means for supporting a person so that said stream of hot water and said bubbles impinge on the body of the person, whereby the person is not subjected to the unheated pool water, and is protected by said dome from adverse weather conditions.

5. A spa-type arrangement for use with a pool filled with unheated water and having a heater comprising:

a pliable container having its rim enclosing a small surface area of the unheated water;

flotation means for supporting said container;

flexible conduit means for introducing hot water into said container below the surface of the water to direct a stream of very hot water into the heated water within said container and to cause the container to bow out from said rim to its full extent;

said flexible conduit means having fitting means for connection to receive hot water from the pool heater; and additional flexible conduit means for returning water from said spa directly to the return from the pool to the heater.

6. A spa-type arrangement as defined in claim 5 wherein means are provided for introducing air under pressure into said container under water to form bubbles in said container.

7. A spa-type arrangement as defined in claim 6 wherein a second flotation means larger than said first flotation means is provided for encompassing said first flotation means, and wherein a second larger pliable container is provided with its rim in sealing engagement with said second flotation means, whereby the air under pressure causes said second pliable container to bow out to its full extent and form an inflated dome over the hot water and bubble-filled container.

8. A fluid control system as defined in claim 7 wherein said second container is provided with first and second circumferentially extending tubes connected to said rim; and wherein means are included for filling said first tube with water and means are further provided for filling said second tube with air.

9. A spa-type arrangement as defined in claim 5 wherein a stiff container is provided in engagement with said pliable container to maintain the shape of said pliable container and provide a supplemental thermal barrier.

* * * * *